US007143618B2

(12) United States Patent
Ni

(10) Patent No.: US 7,143,618 B2
(45) Date of Patent: Dec. 5, 2006

(54) METHOD OF MAKING PRE-FORMED TUBULAR MEMBERS

(75) Inventor: Chi-Mou Ni, Washington, MI (US)

(73) Assignee: General Motors Corporation, Detroit, MI (US)

( * ) Notice: Subject to any disclaimer, the term of this patent is extended or adjusted under 35 U.S.C. 154(b) by 267 days.

(21) Appl. No.: 10/762,403

(22) Filed: Jan. 22, 2004

(65) Prior Publication Data

US 2005/0160783 A1 Jul. 28, 2005

(51) Int. Cl.
*B21D 22/10* (2006.01)

(52) U.S. Cl. ..... 72/61; 72/369; 72/466.2

(58) Field of Classification Search ..... 72/369, 72/370.22, 466.2, 58, 61, 60
See application file for complete search history.

(56) References Cited

U.S. PATENT DOCUMENTS

| | | | | |
|---|---|---|---|---|
| 2,992,479 | A | 7/1961 | Musser et al. | |
| 3,155,139 | A * | 11/1964 | Hautau | 72/150 |
| 3,472,056 | A * | 10/1969 | Gregg | 72/369 |
| 3,579,805 | A | 5/1971 | Kast | |
| 4,481,803 | A * | 11/1984 | Dieser | 72/150 |
| 4,727,744 | A * | 3/1988 | Ferree | 72/466 |
| 5,170,557 | A | 12/1992 | Rigsby | |
| 5,222,552 | A * | 6/1993 | Schuchert | 165/172 |
| 5,333,775 | A | 8/1994 | Bruggemann et al. | |
| 5,685,190 | A * | 11/1997 | Yamamoto et al. | 72/466 |
| 5,720,092 | A | 2/1998 | Ni et al. | |
| 5,845,382 | A * | 12/1998 | Schultz et al. | 29/421.1 |
| 6,183,013 | B1 | 2/2001 | Mackenzie et al. | |
| 6,474,534 | B1 | 11/2002 | Gabbianelli et al. | |
| 6,484,384 | B1 | 11/2002 | Gibson et al. | |
| 6,609,301 | B1 | 8/2003 | Morris et al. | |
| 6,654,995 | B1 | 12/2003 | Wang et al. | |
| 6,701,598 | B1 | 3/2004 | Chen et al. | |
| 6,739,166 | B1 | 5/2004 | Shah | |
| 6,766,678 | B1 * | 7/2004 | Schulze et al. | 72/369 |
| 6,810,705 | B1 * | 11/2004 | Leppin et al. | 72/61 |
| 2003/0204944 | A1 | 11/2003 | Norek | |

FOREIGN PATENT DOCUMENTS

| | | | |
|---|---|---|---|
| DE | 36 34 654 | A1 | 4/1988 |
| DE | 199 55 506 | A1 | 5/2001 |
| DE | 600 07 618 | T2 | 11/2004 |
| JP | 63002520 | A * | 1/1988 |
| JP | 05169145 | A * | 7/1993 |
| JP | 2000190027 | A | 7/2000 |

* cited by examiner

*Primary Examiner*—Lowell A. Larson
*Assistant Examiner*—Teresa M. Bonk
(74) *Attorney, Agent, or Firm*—Laura C. Hargitt

(57) ABSTRACT

A method of making a pre-formed tubular member includes the steps of providing a tubular member extending longitudinally and providing a bending assembly having a mandrel with at least one ball and a bending die. The method also includes the steps of positioning the at least one ball inside of the tubular member. The method further includes the steps of bending the tubular member about the bend die to form a bent pre-formed tubular member having at least one curved portion having a recess therein.

15 Claims, 4 Drawing Sheets

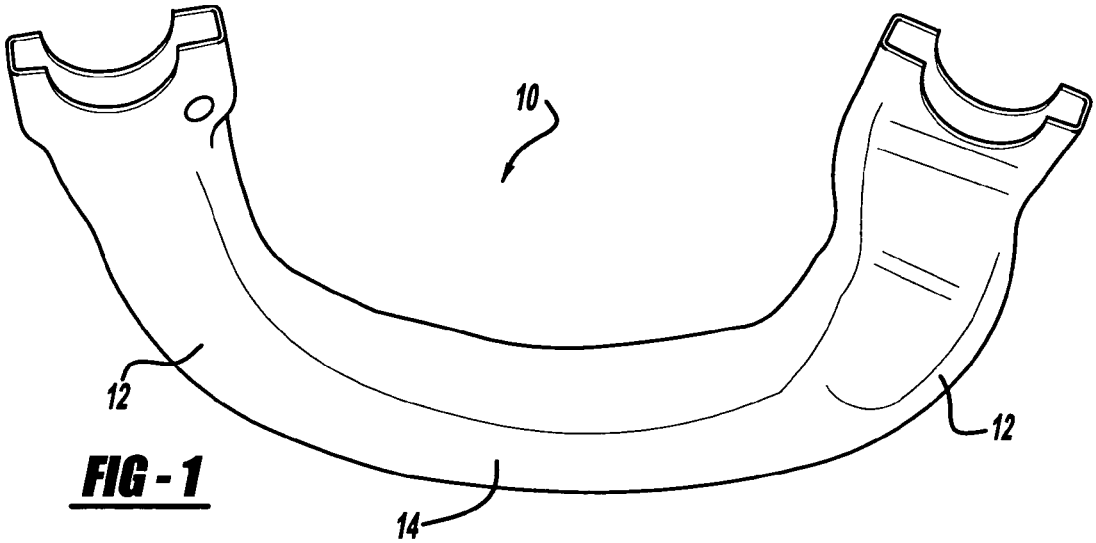
FIG - 1
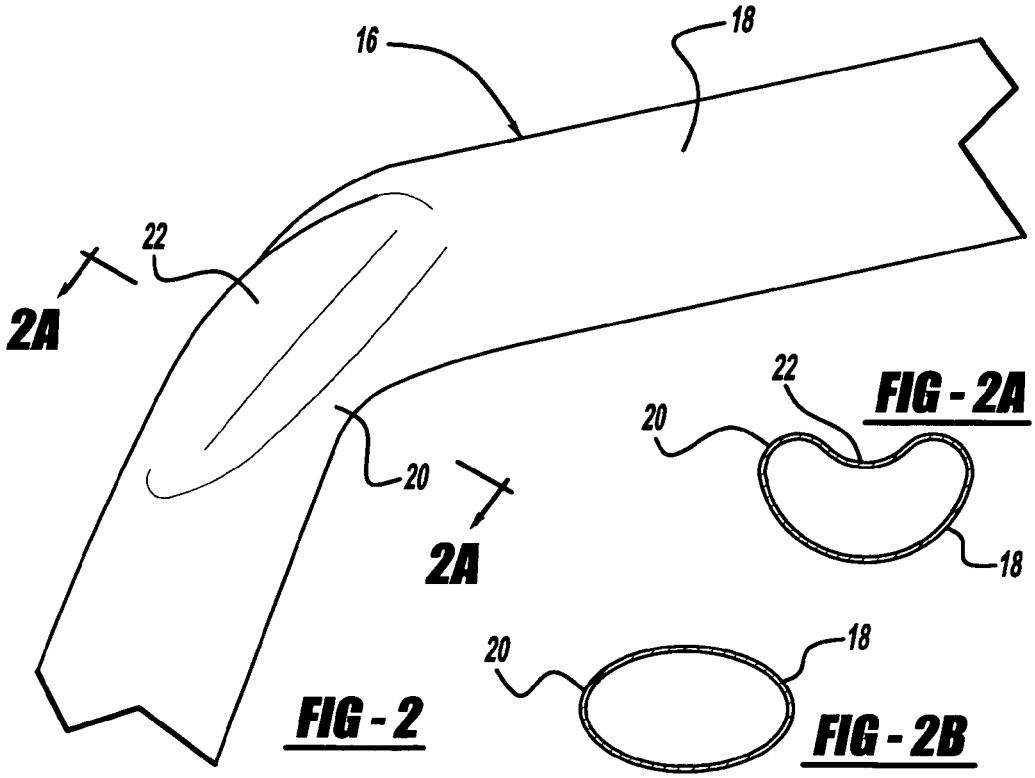
FIG - 2
FIG - 2A
FIG - 2B

METHOD OF MAKING PRE-FORMED TUBULAR MEMBERS

TECHNICAL FIELD

The present invention relates generally to forming a shaped tubular member and, more particularly, to a method of making pre-formed tubular members for hydroformed metal tubing used in assembling automotive structures.

BACKGROUND OF THE INVENTION

It is known to hydroform tubular components. Hydroformed tubular components are becoming increasingly popular in automotive body structural applications. Moreover, curved hydroformed tubular components are used for some of these applications. In general, curved hydroformed tubular components require bent pre-forms before going to the final hydroforming dies for final part shapes. To make good final parts, usually good bent pre-forms are required, which are free of splits or deep wrinkles.

Conventional methods for bending a tube usually employ rotary draw bending machines with a set of bend dies, a mandrel, and other tools. The bent tubes from those bending machines usually have circular cross-sections along the whole length and free of split and deep wrinkles.

Using this traditional practice, there are some limitations regarding a ratio between bend radius (R) and tube diameter (D) of the tube to be acceptable for subsequent hydroforming operation (R/D>2). For lower ductility materials such as high-strength steel and aluminum, the ratio should be larger. In some applications, this limitation on using larger bend radius could restrict some hydroform applications that require tight-bend design features or using alternative light-weight materials.

Another potential problem with a bent tube is wrinkle on its compressive surface, especially for thin gage tube or tightly bent tube. Some of these wrinkles could be flattened out by high pressure used in the hydroforming process, but not for somewhat deep wrinkles. The common practice is to use a wrinkle-free pre-form to ensure successful subsequent hydroforming operation.

As a result, it is desirable to provide a method of making curved hydroformed tubular members. It is also desirable to provide a method of pre-forming tubular members that improves hydroforming formability for a wider range of hydroforming applications. It is further desirable to provide a method of pre-forming tubular members that minimizes thinning and avoids splitting during a bending process. Therefore, there is a need in the art to provide a method of making pre-formed tubular members that meets these desires.

SUMMARY OF THE INVENTION

It is, therefore, one object of the present invention to provide a new method of making pre-formed tubular members.

It is another object of the present invention to provide a method of making bent pre-formed tubular members.

To achieve the foregoing objects, the present invention is a method of making a pre-formed tubular member. The method includes the steps of providing a tubular member extending longitudinally and providing a set of bending tools having a mandrel with at least one ball and a bending die. The method also includes the steps of positioning the at least one ball inside of the tubular member. The method further includes the steps of bending the tubular member about the bend die to form a bent pre-formed tubular member having at least one curved portion having a recess therein.

In addition, the present invention is a method of making a curved hydroformed tubular member. The method includes the steps of positioning a bent pre-formed tubular member having at least one curved portion with a recess therein between open die halves mating with one another to define a tubular cavity portion. The method also includes the steps of progressively closing the die halves to progressively deform the bent pre-formed tubular member within the tubular cavity portion. The method includes the steps of applying hydraulic pressure to expand and conform the bent pre-formed tubular member to the tubular cavity portion to form a curved hydroformed tubular member. The method further includes the steps of separating the die halves and removing the curved hydroformed tubular member from the die.

One advantage of the present invention is that a method of making curved hydroformed tubular members is provided for a vehicle. Another advantage of the present invention is that a method of making bent pre-formed tubular members is provided to hydroform curved tubular members to assemble hydroframe structures. Yet another advantage of the present invention is that the method improves hydroforming formability of light-weight materials such as high-strength steel and aluminum. Still another advantage of the present invention is that the method further expands the hydroforming process to tightly-bent parts (R/D<1.5) such as some suspension components for a vehicle. A further advantage of the present invention is that the method improves hydroformed part quality by ensuring more uniform straining. Yet a further advantage of the present invention is that the method is less expensive than conventional deep drawing processes.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a perspective view of a curved hydroformed tubular member formed by a method, according to the present invention.

FIG. 2 is a perspective view of a portion of a bent pre-formed tubular member used in forming the curved hydroformed tubular member of FIG. 1.

FIG. 2A is a sectional view taken along line 2A—2A of FIG. 2.

FIG. 2B is a view similar to FIG. 2A of another embodiment of the bent pre-formed tubular member.

DESCRIPTION OF THE PREFERRED EMBODIMENT

Figure 3:
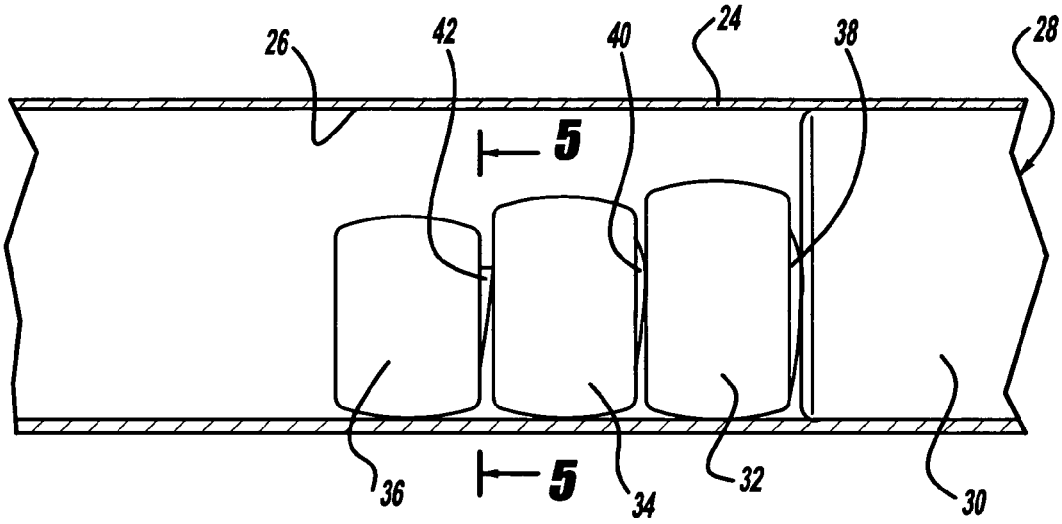
FIG. 3 is a fragmentary elevational view of a bent pre-formed tubular member formed by a method, according to the present invention, of making a pre-formed tubular member illustrating a first step of the method.

Referring to the drawings and in particular FIG. 1, one embodiment of a curved hydroformed tubular member 10, according to the present invention, for assembly in automotive structures (not shown). The curved hydroformed tubular member 10 is a suspension member used in a suspension system (not shown) of vehicle such as an automotive vehicle. The curved hydroformed tubular member 10 has at least one, preferably a pair of curved portions 12 interconnected by a substantially straight or linear portion 14. The curved hydroformed tubular member 10 is formed by a method, according to the present invention, of hydroforming a bent pre-formed tubular member, generally indicated at 16, to be described. It should be appreciated that the curved hydroformed tubular member 10 may have a ratio of bend radius (R) to diameter (D) less than a predetermined value (R/D<1.5) due to packaging constraints in the vehicle. It should be appreciated that, except for the method, the curved hydroformed tubular member 10 is conventional and known in the art.

Referring to FIG. 2, a bent pre-formed tubular member 16 is illustrated for use in carrying out a method, according to the present invention, of hydroforming a curved hydroformed tubular member. The bent pre-formed tubular member 16 includes a straight or linear portion 18 and at least one bent portion 20 formed from the straight portion 18. The bent portion 20 has a recess or caved in portion 22 extending therein as illustrated in FIGS. 2 and 2A. In another embodiment, the bent portion 20 has a generally elliptical cross-sectional shape as illustrated in FIG. 2B. The bent pre-formed tubular member 16 is formed by a method, according to the present invention, of making a bent-pre-formed tubular member to be described. It should be appreciated that the straight portion 18 corresponds to the straight portion 14 and the curved portion 22 corresponds to one of the curved portions 12 before and after hydroforming, respectively.

Figure 4:
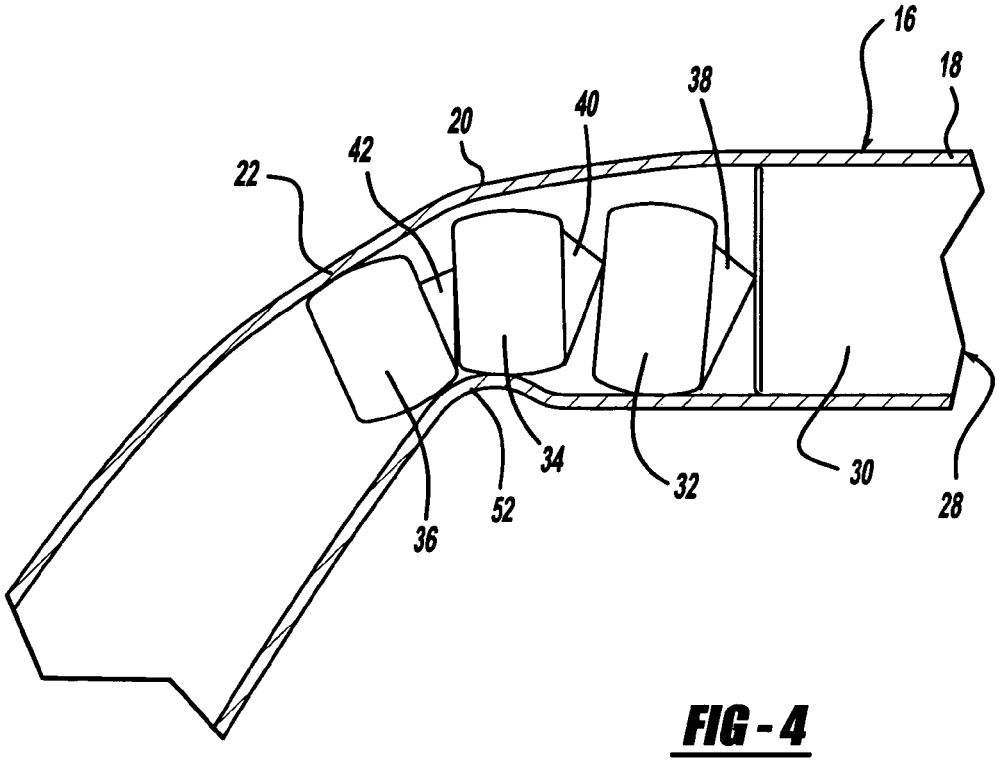
FIG. 4 is a view similar to FIG. 3 illustrating a second step of the method.
Figure 5A:
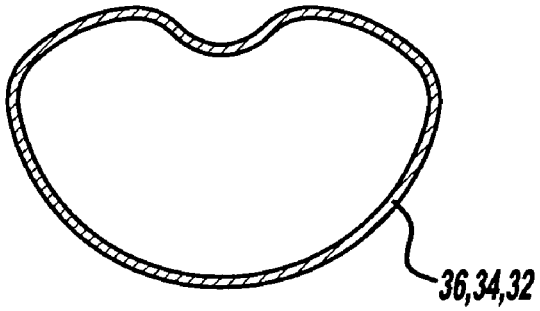
FIG. 5 is a sectional view taken along line 5—5 of FIG. 3.
FIG. 5B is a view similar to FIG. 5 of another embodiment of the bent pre-formed tubular member.
Figure 5B:
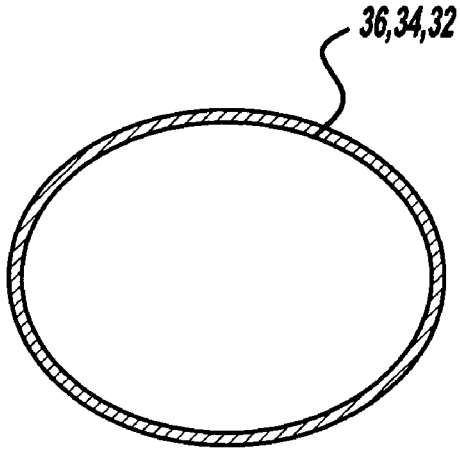

Referring to FIGS. 3 through 5, a method, according to the present invention, of making the pre-formed tubular member 16 is shown. The method includes the step of providing a tubular member 24. The tubular member 24 is made of a ductile metal material such as aluminum or high-strength steel. The tubular member 24 has a wall thickness of a predetermined value such as three millimeters (3 mm). In one embodiment, the tubular member 24 has a generally circular cross-sectional shape with a hollow interior 26. The tubular member 24 extends axially or linearly. It should be appreciated that the tubular member 24 is conventional and known in the art.

Referring to FIGS. 3 through 8, in one embodiment, the method includes the step of providing a set of bending tools or bending assembly, generally indicated at 28, to bend the tubular member 24 to form the bent pre-formed tubular member 16 with at least one curved portion 20 therein. The bending assembly 28 includes a mandrel 30 having a generally cylindrical shape and a generally circular cross-sectional shape. It should be appreciated that the mandrel 30 is disposed in the interior 26 of the tubular member 24 at a location adjacent for the bend or curved portion is to be formed.

The bending assembly 28 also includes at least one, preferably a plurality of, more preferably a first, second, and third ball 32, 34, and 36, respectively, connected to the mandrel 30. The first, second, and third balls 32, 34, and 26 are generally cylindrical in shape with a generally kidney cross-sectional shape similar to the mandrel 30 and have a cross-section less than a cross-section of the mandrel 30 as illustrated in FIG. 5. In another embodiment, the first, second, and third balls 32, 34, and 26 are generally cylindrical in shape with a generally round or oval cross-sectional shape as illustrated in FIG. 5A. The first, second, and third balls 32, 34, and 36 have a diameter or height less than an inner diameter of the tubular member 24. The first ball 32 has a diameter or height greater than the second ball 34. The second ball 34 has a diameter or height greater than the third ball 36. Each of the first, second, and third balls 32, 34, and 36 are interconnected by links 38, 40, and 42, respectively, extending axially from the mandrel 30 and through at least one axial end of the balls 32, 34, and 36. The links 38, 40, and 42 are flexible and allow the balls 32, 34, and 36 to move relative to one another. It should be appreciated that the balls 32, 34, and 36 are disposed in the interior 26 of the tubular member 24 adjacent the rigid mandrel 30.

Figure 6:
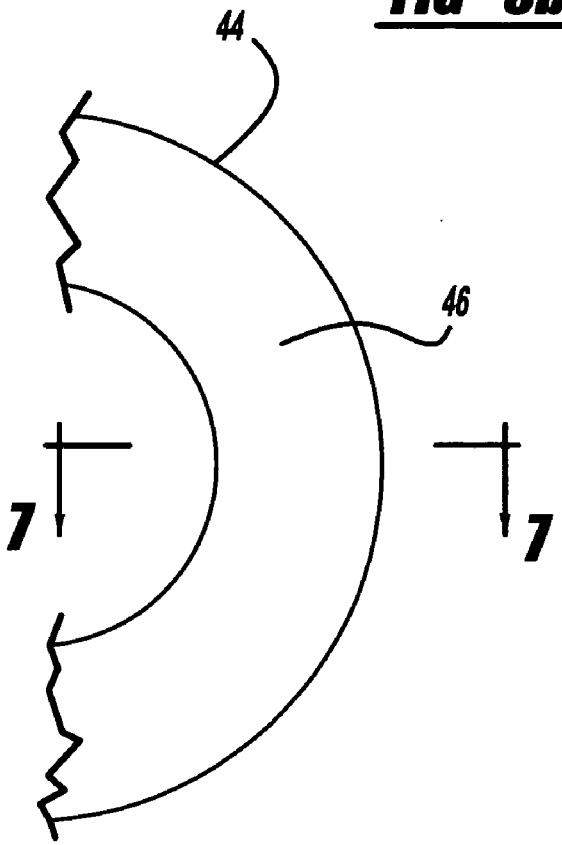
FIG. 6 is a plan view of a bend die used in forming the curved hydroformed tubular member of FIG. 1.
Figure 7:
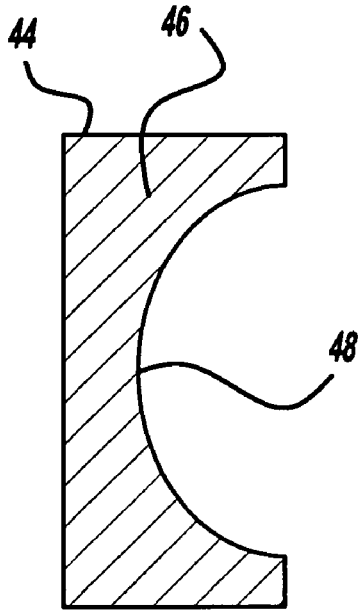
FIG. 7 is a sectional view taken along line 7—7 of FIG. 6.
Figure 8:
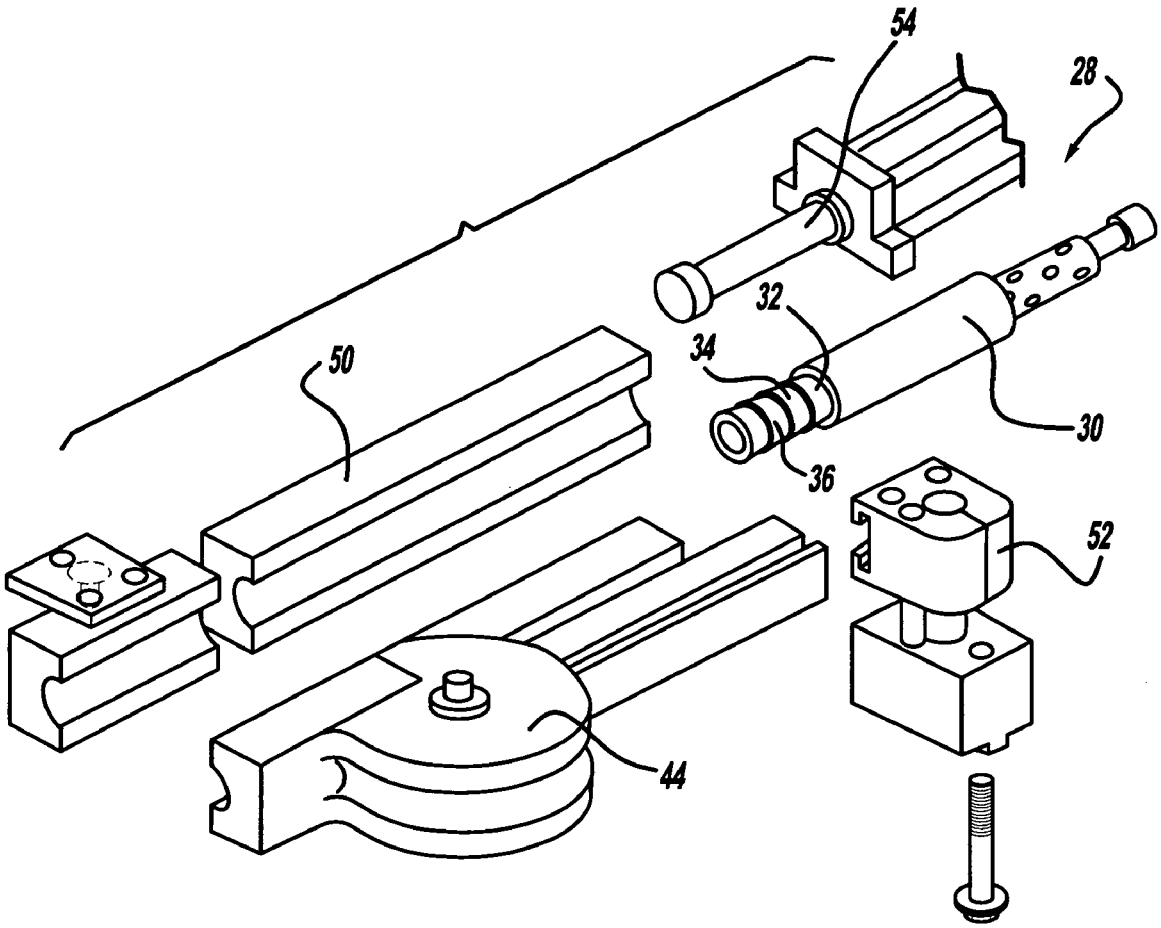
FIG. 8 is a perspective view of a bending assembly used in forming the curved hydroformed tubular member of FIG. 1.

The bending assembly 28 further includes a bend die 44 as illustrated in FIGS. 6 through 8. The bend die 44 has an arcuate or curved portion 46 with a recess or channel 48 (FIG. 7) having a generally elliptical cross-sectional shape. As illustrated in FIG. 8, the bending assembly 28 may include a clamp die 50, clamp 52, and actuator 54. It should be appreciated that the mandrel 30 and balls 32, 34, and 36 bend the tubular member 24 about the bend die 44 to form the bend or curved portion 20 in the bent pre-formed tubular member 16. It should be appreciated that the clamp die 50, clamp 52, and actuator 54 are conventional and known in the art.

The method includes the step of positioning the balls 32, 34, and 36 and mandrel 30 inside or in the interior 26 of the tubular member 24 and positioning the tubular member 24 adjacent the bend die 44. The method includes the step of bending the tubular member 24 to form the bent pre-formed tubular member 16. The mandrel 30 is moved relative to the bend die 44 by the actuator 54 to bend the tubular member 24 around the bend die 44 to form the curved portion 20. As the tubular member 24 is bent on the bend die 44, the balls 32, 34, and 36 cause a wall of the tubular member 24 to cave in or collapse to form the caved in portion 22. Due to the different height between the second and third balls 34 and 36, an indented portion 52 is formed opposite the caved in portion 22 in the bent pre-formed tubular member 16. It should be appreciated that the method allows the tensile surface of the tubular member 24 to "cave in" as much as required to reduce "tensile strains" to minimize thinning and avoid splitting during the bending process. It should also be appreciated that, to avoid deep wrinkles on the compressive surface, the method requires the profile of the mandrel 30 illustrated in FIG. 5 for thin-gage tubing. It should further be appreciated that, for some thick gage tube, no mandrel 30 is needed. It should still further be appreciated that the bent pre-formed tubular member 16 is hydroformed in a manner to be described.

A method, according to the present invention, of making the curved hydroformed tubular member 10 is disclosed. The method includes the step of hydroforming the bent pre-formed tubular member 16 to form the curved hydroformed tubular member 10. The bent pre-formed tubular member 16 is placed in a die set comprised of an upper die half (not shown) and a lower die half (not shown). The upper die half includes a tubular forming cavity portion. Likewise, the lower die half includes a tubular forming cavity portion.

The ends of the bent pre-formed tubular member 16 are sealed and hydraulic fluid is pumped into the bent pre-formed tubular member 16 under pressure. The upper die half and lower die half are progressively closed so that the bent pre-formed tubular member 16 is progressively deformed and the pressurized fluid captured therein expands the walls of the bent pre-formed tubular member 16 into the cavity portions of the die.

The die halves are fully closed upon one another with the bent pre-formed tubular member 16 being tightly clamped between the die halves. During this closing of the die halves, a relatively constant hydraulic pressure may be maintained within the bent pre-formed tubular member 16 by incorporating a pressure relief valve (not shown) into the seal enclosing the ends of the bent pre-formed tubular member 16 so that hydraulic fluid may be forced from the bent pre-formed tubular member 16 as it collapses.

Once the die is closed, the bent-pre-formed tubular member 16 is then expanded to a final cross-sectional profile by increasing the hydraulic pressure sufficient to exceed the yield limit of the bent pre-formed tubular member 16 so that the bent pre-formed tubular member 16 is forced into conformity with the tubular forming cavity portions of the die halves. The die halves 26 are then opened to permit removal of the finished or curved hydroformed tubular member 10 from the die halves. The curved hydroformed tubular member 10 may be assembled into a vehicle body (not shown) or some other desired vehicle component. It should be appreciated that, because of the reduced strains from the bending process in the bent pre-formed tubular member 16, there is much ductility of the material left for the hydroforming process to use and thus a greater range of curved hydroformed components can be produced.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A method of making a pre-formed tubular member, said method comprising the steps of:

providing a tubular member extending longitudinally;

providing a bending assembly having a mandrel with at least one ball and a bend die;

positioning the at least one ball inside of the tubular member; and bending the tubular member about the bend die to form a bent pre-formed tubular member having at least one curved portion with a collapsed wall to form a caved in portion on the at least one curved portion.

2. A method as set forth in claim 1 wherein the mandrel has a generally circular cross-sectional shape.

3. A method as set forth in claim 1 including the step of positioning a portion of the mandrel inside the tubular member prior to said step of bending.

4. A method as set forth in claim 1 wherein the bend die has a generally elliptical cross-sectional shape.

5. A method as set forth in claim 1 wherein the at least one ball has a cross-section less than a cross-section of the mandrel.

6. A method as set forth in claim 1 wherein said step of providing a bending assembly further comprises providing a first ball, a second ball, and a third ball.

7. A method as set forth in claim 6 wherein the first ball and the second ball have a similar cross-sectional shape.

8. A method as set forth in claim 6 wherein the first ball and the second ball have a height greater than a height of the third ball.

9. A method as set forth in claim 6 wherein the first ball, second ball, and third ball each have a projection extending axially outwardly.

10. A method as set forth in claim 1 wherein said step of providing a tubular member comprises providing a tubular member having a generally circular cross-sectional shape.

11. A method as set forth in claim 1 wherein the tubular member is made of a metal material.

12. A method of making a curved hydroformed tubular member, said method comprising the steps of:

making a bent pre-formed tubular member wherein said step of making the bent pre-formed tubular member comprises providing a tubular member extending longitudinally and a bending assembly having a mandrel with at least one ball and a bend die;

positioning the bent pre-formed tubular member having at least one curved portion with a collapsed wall forming a caved in portion on the at least one curved portion between open die halves mating with one another to define a tubular cavity portion;

progressively closing the die halves to progressively deform the bent pre-formed tubular member within the tubular cavity portion;

applying hydraulic pressure to expand and conform the bent pre-formed tubular member to the tubular cavity portion to form a curved hydroformed tubular member; and separating the die halves and removing the curved hydroformed tubular member from the die.

13. A method as set forth in claim 12 wherein said step of making the bent pre-formed tubular member further comprises positioning the at least one ball inside of the tubular member.

14. A method as set forth in claim 13 wherein said step of making the bent pre-formed tubular member further comprises bending the tubular member about the bend die to form the bent pre-formed tubular member having at least one curved portion having a recess therein.

15. A method of making a curved hydroformed tubular member, said method comprising the steps of:

providing a tubular member extending longitudinally;

providing a bending assembly having at least one ball and a bend die;

positioning the at least one ball inside of the tubular member;

bending the tubular member about the bend die to form a bent pre-formed tubular member having at least one curved portion with a collapsed wall to form a caved in portion on the at least one curved portion;

positioning the bent pre-formed tubular member between open die halves mating with one another to define a tubular cavity portion;

progressively closing the die halves to progressively deform the bent pre-formed tubular member within the tubular cavity portion;

applying hydraulic pressure to expand and conform the bent pit-formed tubular member to the tubular cavity portion to form a curved hydroformed tubular member; and separating the die halves and removing the curved hydroformed tubular member from the die.

* * * * *